US006752707B1

(12) United States Patent
Palushi

(10) Patent No.: US 6,752,707 B1
(45) Date of Patent: Jun. 22, 2004

(54) WOOD FLOOR SANDING MACHINE

(75) Inventor: Simon Palushi, Shelby Township, MI (US)

(73) Assignee: On Floor Technologies, L.L.C., Madison Heights, MI (US)

( * ) Notice: Subject to any disclaimer, the term of this patent is extended or adjusted under 35 U.S.C. 154(b) by 0 days.

(21) Appl. No.: 10/393,060

(22) Filed: Mar. 20, 2003

Related U.S. Application Data

(63) Continuation-in-part of application No. 09/935,070, filed on Aug. 22, 2001, now Pat. No. 6,616,517, which is a continuation-in-part of application No. 09/911,249, filed on Jul. 23, 2001, now Pat. No. 6,595,838.

(51) Int. Cl.[7] ..... B24B 23/00
(52) U.S. Cl. ..... 451/350; 451/357
(58) Field of Search ..... 451/350, 351, 451/352, 353, 357, 358, 270, 271, 340, 344; 299/39.1, 39.5, 40.1

(56) References Cited

U.S. PATENT DOCUMENTS

| | | | | |
|---|---|---|---|---|
| 1,601,087 | A | 9/1926 | Simpson | |
| 3,098,329 | A | 7/1963 | Doran | |
| 3,128,581 | A | 4/1964 | Tosetti | |
| 3,169,262 | A | 2/1965 | Allen et al. | |
| 3,354,488 | A | 11/1967 | Blide | |
| 3,721,048 | A | 3/1973 | Rand | |
| 4,097,950 | A | 7/1978 | Satterfield | |
| 4,150,456 | A | 4/1979 | Alvarez et al. | |
| 4,155,596 | A | 5/1979 | Brejcha | |
| 4,182,001 | A | 1/1980 | Krause | |
| 4,634,188 | A | 1/1987 | Persson | |
| 4,709,510 | A | 12/1987 | Giovanni et al. | |
| 4,862,548 | A | 9/1989 | Sergio | |
| 4,862,766 | A | 9/1989 | Molders | |
| 5,209,961 | A | 5/1993 | Yokoi | |
| 5,224,301 | A | 7/1993 | Tasikas | |
| 5,314,386 | A | 5/1994 | Eide et al. | |
| 5,377,375 | A | 1/1995 | Holman et al. | |
| 5,439,413 | A | 8/1995 | Lagler | |
| 5,454,751 | A | 10/1995 | Wiand | |
| 5,507,061 | A | 4/1996 | Miyazaki | |
| 5,637,032 | A | 6/1997 | Thysell et al. | |
| 5,772,497 | A | 6/1998 | Dummermuth | |
| 5,829,095 | A | 11/1998 | Legatt et al. | |
| 5,863,241 | A | 1/1999 | Rottschy | |
| 5,875,506 | A | 3/1999 | Plazanet | |
| 5,905,927 | A | 5/1999 | Inoue et al. | |
| 5,980,371 | A | 11/1999 | McConnell | |
| 6,148,476 | A | 11/2000 | Legatt et al. | |
| 6,353,957 | B1 * | 3/2002 | Wolfe et al. | 15/49.1 |
| 6,485,360 | B1 * | 11/2002 | Hutchins | 451/357 |
| 6,616,517 | B2 * | 9/2003 | Palushi | 451/350 |

OTHER PUBLICATIONS

Alto, American Sanders Technology, Alto U.S. Inc. 390 South Woods Mills Road, Chesterfield, MO 63017–3433 Catalog.

Lagler, Palo Duro Hardwoods, Inc. 4800 Lima Street, Denver Colorado 80239 Catalog.

Cimex International, 100 Stradtman Street, Buffalo New York 14206 Catalog.

Innovatech, 19722 144th Avenue, NE Woodinville, WA 98072 Catalog.

* cited by examiner

*Primary Examiner*—Dung Van Nguyen
(74) *Attorney, Agent, or Firm*—Reising, Ethington, Barnes, Kisselle, P.C.

(57) ABSTRACT

A power sanding machine (10) has three circumferentially spaced cogged belts (40) to drive three discs (52) rotatably mounted to an inner bowl (30) which is rotatably mounted to a housing (12), which in turn is connected to an operating handle (14). Mechanical lock can rotationally affix the inner bowl (30) to the housing to circumferentially position a pulley at the left or right edge (326, 322) of the sanding machine or at the front end (330) of the sanding machine.

16 Claims, 14 Drawing Sheets

WOOD FLOOR SANDING MACHINE

This is a continuation-in-part application, of U.S. Ser. No. 09/935,070, filed on Aug. 22, 2001 now U.S. Pat. No. 6,616,517, which is a CIP of Ser. No. 09/911,249 filed Jul. 23, 2001 now U.S. Pat. No. 6,595,835.

TECHNICAL FIELD

The field of this invention relates to power floor sanding machines with interchangeable attachments and more particularly to wood floor sanding machines.

BACKGROUND OF THE DISCLOSURE

Hardwood floors have long been a desirable trait in a home. However, sanding and refurbishing a hardwood floor is one of the more difficult do-it-yourself tasks for a homeowner.

There are at present two basic types of sanding machines on the market. Firstly, there is a drum sander that has a single large drum that retains a sheet of abrasive material thereon. The large drum aggressively sands the floor but much care and skill must be used in feathering the machine to avoid gouging of the floor. This type of drum is usually not recommended for the do-it yourself market.

Another type of machine is a disc sander. The present sanding machines on the market commonly have a single belt that drive all three sanding discs which creates a side torque that drives the machine to one side as it sands the floor. The operator then needs to always counter the torque that promotes an uneven surface finishing and fatigue on the operator for larger sanding jobs.

Many machines also have higher operating speeds that allow little error in operating the machines. The high operating speeds can quickly cause gouging and knicks in the wood floor without having time to control or eliminate these gouges. Furthermore, the high operating speeds produce significant amount of noise.

The disc sander machines are not as aggressive as the drum type machines. Attempts have been made to increase the sanding force of the discs by increasing the weight of the sander. These weights are obtrusive horseshoe shaped steel members that are mounted on top of the sander housing. The external weights require an extra fastening device and if not tightly mounting the weights, extra chatter and vibration may occur.

These sanding machines also have a housing edge that is widely spaced from the operating sanding discs. This prevents the machine to sand close to walls. Furthermore the housing may have a high periphery which prevents it from intruding under the toe recess under many kitchen cabinets. As a result, even after adding a shoe molding to the edge of the floor, an unsanded edge may be showing. Therefore, additional smaller edge sanders need to be extensively used to approach the edge of the floor which further make the sanding process difficult.

Furthermore, the sanding creates great amount of sawdust, which needs to be controlled. The sawdust if not controlled can fill the room creating a mess and interfering with the visibility of the floor as it is being sanded. Secondly, uncontrolled sawdust, particularly when air born, may under certain circumstances be combustible from sparks or other ignition sources. If a vacuum is difficult to use on a floor sander, complacency is promoted in allowing loose saw dust to accumulate.

Furthermore, for do-it-yourself applications, an operator often leases or rents a machine which therefore requires the operator to carry the machine from the rental outlet. If the machine is not easily disassembled to easily carried components, the weight of the machine may cause difficulty for the operator to transport the sander between the rental place and his home. Furthermore, the need to rent separate, aggressive drum sanders, disc sanders, and square buffers limits the marketplace. Any person attempting to sand a floor himself may become discouraged if too many different pieces of equipment are needed or if the length of the job is too long and difficult.

The drum sanders, orbital sanders, and square buff sanders not only make it difficult for the do-it-yourself person but also for rental outlets in that the market is relatively small and the rental outlet must store a plurality of specialized machines.

What is needed is a machine that with appropriate attachments can replace a drum sander, orbital sander, square buff sander, as well as a diamond grinder, scarifier, and carpet scrubber.

What is also needed is a floor sander that can be aggressive in order to accomplish a commonly sized residential job within a reasonable amount and also be safe enough to significantly reduce gouging of the floor. What is also needed is a floor sander that can approach an edge of a floor within the distance of an ordinary shoe molding while reducing noise, that increases control and ease of use, reduces saw dust, and provides other conveniences for making a do-it-yourself operation feasible.

SUMMARY OF THE DISCLOSURE

In accordance with one aspect of the invention, a power sander for a wood floor includes a housing, and a motor mounted to the housing and having a centrally positioned downwardly extending drive shaft. An inner bowl member, i.e., inner housing member, is positioned within the housing and is rotatably mounted on the drive shaft to allow rotation of the inner bowl with respect to both the housing and drive shaft. Pulleys are circumferentially spaced about the drive shaft and are rotatably connected to the inner bowl member. The axis of rotation of each pulley is parallel to the axis of rotation of the drive shaft. Each pulley constructed to have sander discs mounted thereon. A plurality of belts, with each belt preferably having a cogged inside and mounted about one pulley and engageably driven by the drive shaft.

The drive shaft and said pulleys having respective cogged peripheries for creating a positive engagement with said inner side of the respective belts. A plurality of pulley tensioners engage the outer side of a respective belt with the outer side preferably being flat and frictionally engaged by the pulley tensioners in the form of bearings.

The belts are vertically spaced with respect to the drive shaft at a vertical position adjacent from one another. Each respective pulley is respectively vertically positioned to engage its respective belt horizontally from the engaging vertical position on the drive shaft. Each tensioner also is vertically positioned to a proper height to operably engage its respective belt.

The housing is preferably bell shaped with a downwardly extending side wall and connectable to a vacuum motor for suction of saw dust up through the bell shaped housing. The housing has an aperture for connection to a vacuum hose for allowing vacuuming of sawdust up through the housing and through the aperture. A weighted metal plate is attached to an inner bowl member. The weighted metal plate has apertures for allowing the pulley to extend therethrough. The plate has an outer periphery spaced from the side wall of said housing to define a path for the vacuuming of the saw dust.

It is desirable that a weighted plate is mounted to the inner bowl and has notches at its outer periphery to create widened gaps with the housing to increase air flow therebetween. It is also preferred that the housing has its side walls spaced within ⅜ inches from a sanding disc edge. The housing has handles mounted thereon near a front and rear portion thereof and extending upwardly therefrom. The housing also has a plurality of quick connect pins that removably connect the housing to the operating handle.

In accordance with another embodiment of the invention, the center drive shaft has a gear section, these gears are circumferentially spaced about the drive shaft and are rotatably mounted on the inner bowl member in a coplanar fashion and operably engage the center gear section of the drive shaft. The gears having respective pulley sections affixed thereto with the pulley sections being coplanar with each other. The pulleys are coplanar with each other and with the pulley sections. The belts are also coplanar and engage a pulley section of the respective gear and the pulleys.

In accordance with another aspect of the invention, a vacuum cleaner is mounted to the operable handle. A vacuum hose operably extends from the vacuum cleaner and is resiliently flexible and stretchable from a rest length to an increased length. The distal end of the hose has a shaped nozzle that can receive a hose coupling on the housing. This structure allows the hose to be directly connected to the hose coupling without removal of the shaped nozzle for vacuuming sawdust out of the housing. The hose is also being detachable from the hose coupling to allow the shaped nozzle to be operably used. The vacuum is grounded to the power sanding machine and preferably has a metal canister.

In accordance with another embodiment of the invention, a power sander for a wood floor includes a housing, and a motor mounted to the housing with a drive shaft. An inner housing member preferably in the form of a bowl is positioned within the housing and is rotatably mounted on the drive shaft to allow rotation of the inner housing with respect to both the housing and drive shaft. Pulleys are circumferentially spaced about the drive shaft and are operably connected to the drive shaft and also rotatably connected to the inner housing member.

Each pulley is constructed to have a sanding member mounted thereon. The sanding member includes a plate mounted to the pulley and at least one roller rotatably mounted about a horizontal axis on said plate. Each roller is fittable with an abrasive sanding layer about its outer surface and abuttable to a floor surface at its bottom section.

Preferably, each roller has its axis of rotation being transverse to and intersecting the axis of rotation of the respective plate that is mounted on the pulley. It is also desirable that each roller is freewheeling on the respective plate.

In one embodiment, a plurality of rollers are circumferentially spaced about the plate with each of its axis of rotation intersecting with each other and the axis of the plate. It is preferred that the plate has cutouts for allowing the rollers to be partially recessed in the cutouts. Each roller has an axial length that is greater than its own diameter.

In accordance with a broader aspect of the invention, a power sander for a wood floor includes a housing and a motor mounted to the housing with a drive shaft. An inner rotatably driven member is positioned within the housing and is driven by the drive shaft to allow rotation of the inner rotatably driven member with respect to the housing about a vertical axis. At least one roller is rotatably mounted about a horizontal axis on the inner rotatably driven member. The roller is fittable with an abrasive sanding layer about its outer surface and abuttable to a floor surface at its bottom section.

In accordance with another aspect of the invention, a power sander for a wood floor includes a rotating member that rotates about a vertical axis. Rollers are circumferentially spaced about the rotating member with each roller rotatably mounted about a horizontal axis on the rotating member. Each horizontal axis of rotation intersects with each other and an axis of rotation of the rotating member. Each roller is freewheeling on the rotating member. Each roller is fitted with an abrasive outer sanding layer about its outer surface and abuttable to a floor surface at its bottom section.

In accordance with another aspect of the invention, an attachment for a power sander includes a plate for attachment to a rotatable pulley. At least one roller is rotatably mounted about a horizontal axis onto the plate. The roller is fittable with an abrasive sanding layer about its outer surface and abuttable to a floor surface at its bottom section. Each roller has its axis of rotation being transverse to and intersecting the axis of rotation of the plate. Each roller is freewheeling on the plate. Preferably, rollers are circumferentially spaced about the plate with each roller having its axis of rotation intersecting with each other. Furthermore it is desired that the plate has cutouts for allowing the rollers to be partially recessed in the cutouts. Each roller is dimensioned to have an axial length that is greater than the roller diameter.

In accordance with another aspect of the invention, an attachment for a power sander includes a plate mountable to a power sander. The plate has a plurality of carbide steel shaped cutting members mounted cicumferentially about the plate. The carbide steel tips having a planar bottom surface and tapered sides to create a sharp scarifying edge.

In accordance with another aspect of the invention, a power cleaning and sanding machine for a wood floor includes a housing, a motor mounted to the housing and having a drive shaft. An inner housing member is positioned within the housing and is rotatably mounted on the drive shaft to allow rotation of the inner housing member with respect to both the housing and drive shaft. A plurality of pulleys is circumferentially spaced about the drive shaft and is operably connected to the drive shaft, and rotatably connected to said inner housing member. Each pulley is constructed to have a abrasive member mounted thereon. The inner housing is selectively rotationally affixed to the housing by a mechanical lock that is able to lock a pulley in a circumferentially selected position about the drive shaft.

In one embodiment, the mechanical lock is in the form of a pin movable between a lower position extendable through an aperture in the housing and engaging a recess in the inner housing and an upper position where it is removed from the recess in the inner housing. Preferably, the recess in the inner housing is circumferentially positioned about the inner housing such that when the pin engages the recess, one of the pulleys is positioned toward one of the right or left sides of the housing member. In another embodiment, the housing recess in the inner housing is circumferentially positioned about the inner housing such that when the pin engages the recess, one of the pulleys is positioned at the front end of the housing.

The mechanical lock is preferably constructed to selectively lock any of the pulleys to be positioned at the left or right sides of said housing. The mechanical lock can also be constructed to selectively lock any of the pulleys at the left or right side or front end of the housing.

The housing has a first and second recess with the first recess, when engaged with the pin, locks one pulley at the left side of the housing and with the second recess, when engaged with the pin, locks one pulley at the right side of the housing member. In another embodiment, the housing has a third recess with the third recess, when engaged with the pin, locks the pulley at the front end of the housing.

In accordance with another aspect of the invention, an operable handle extends behind the rear end of the housing. A motor is mounted to the housing and has a centrally positioned downwardly extending drive shaft. An inner housing member is positioned within the housing and is rotatably mounted on the drive shaft to allow rotation of the inner housing member with respect to both the housing and drive shaft. A plurality of pulleys is circumferentially spaced about the drive shaft and rotatably connected to the inner housing member. The axis of rotation of each pulley is parallel to the axis of rotation of the drive shaft. Each pulley is constructed to have abrasive elements mounted thereon. Belts mounted about respective pulleys are engageably driven by the drive shaft. A mechanical lock is constructed to selectively lock the inner housing against rotation with respect to the housing. The inner housing member is freely rotatable with respect to the housing when the mechanical lock is disengaged and for affixing a pulley at a side edge of the housing when engaged to affix the inner housing member with the housing.

BRIEF DESCRIPTION OF THE DRAWINGS

Reference now is made to the accompanying drawings in which.

DETAILED DESCRIPTION OF THE PREFERRED EMBODIMENT

Figure 1:
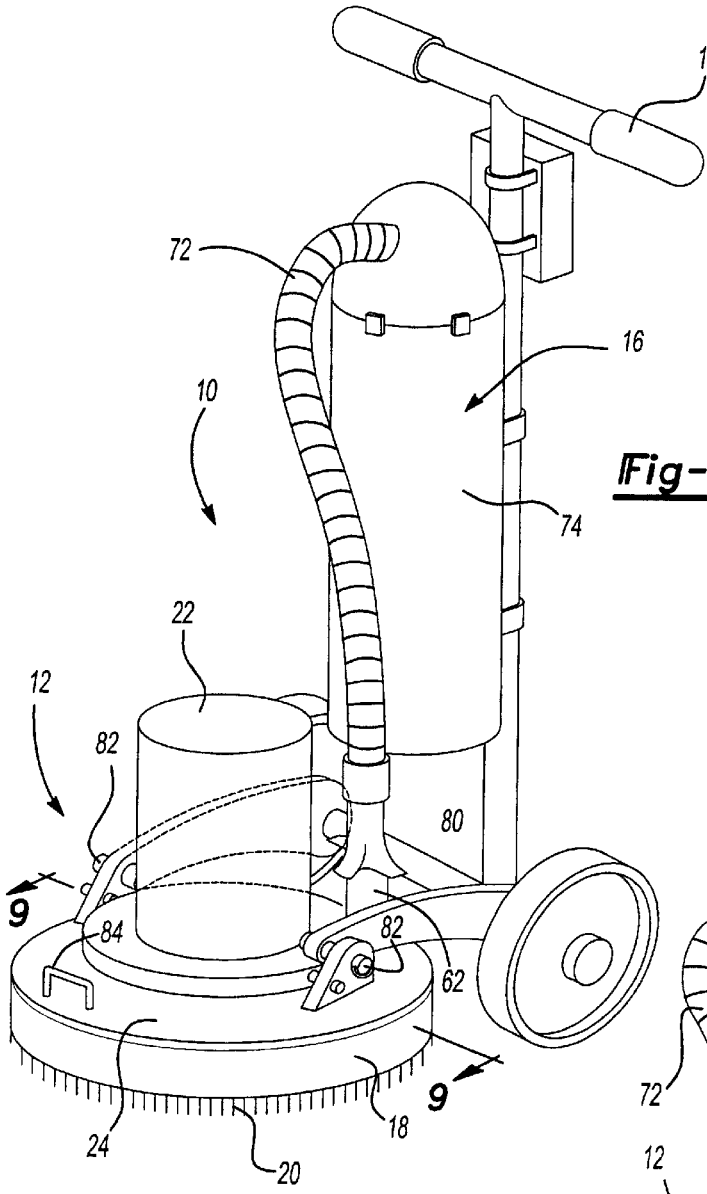
FIG. 1 is a front perspective view of a floor sander in accordance with one embodiment of the invention.

Referring now to FIG. 1, a floor sander 10 has a housing 12 connected to an operating handle 14. A vacuum 16 is mounted on the operating handle. The housing 12 has a generally bell shape with a side peripheral section 18 that mounts a peripheral brush 20. A motor 22 is mounted on the top portion 24 of the housing 12.

Figure 9:
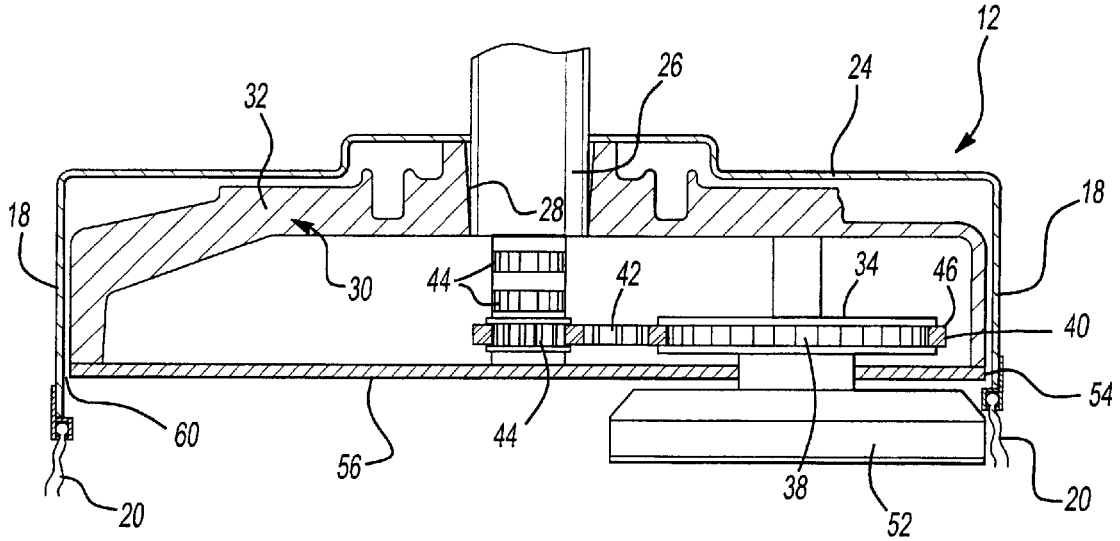
FIG. 9 is a cross sectional view of the housing taken along lines 9—9 shown in FIG. 1.
Figure 10:
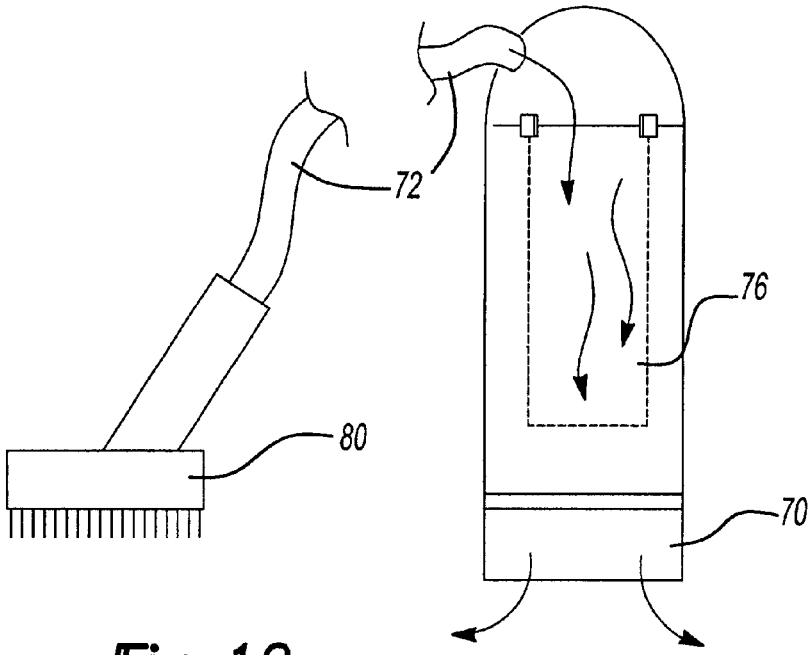
FIG. 10 is a schematic internal view of the vacuum that is mounted on the operating handle.

As shown in FIG. 9, the motor has a drive shaft 26 that extends down through the top portion 24 of the housing. The motor 22 is electric and is operably connected to a power cord (not shown) that can conventionally be plugged into a 110 volt receptacle.

Figure 5:
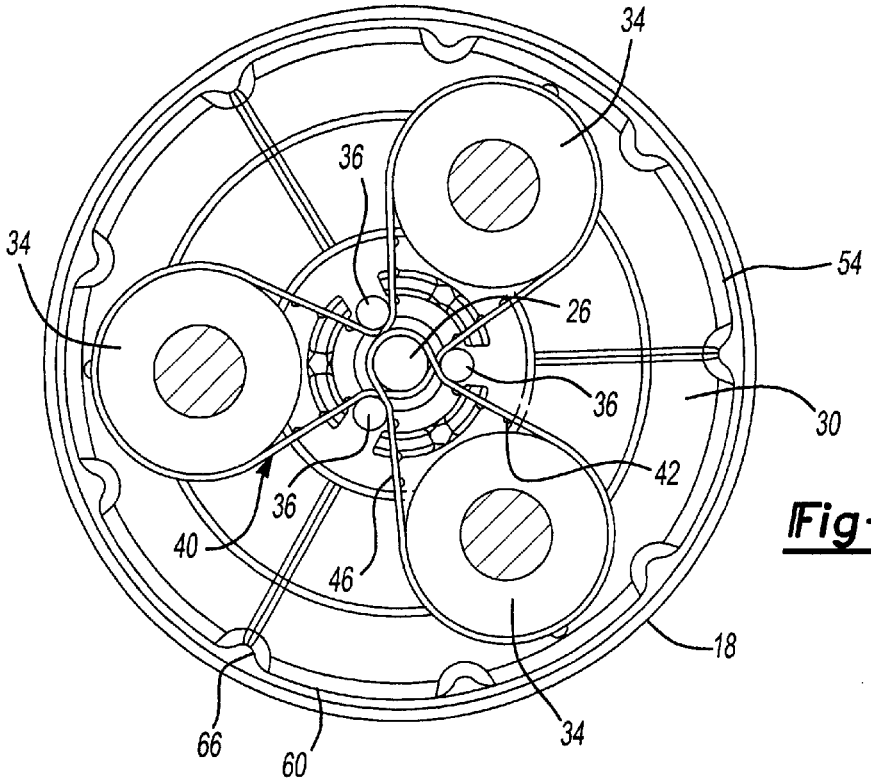
FIG. 5 is a cross sectional view taken along lines 5—5 shown in FIG. 3.
Figure 7:
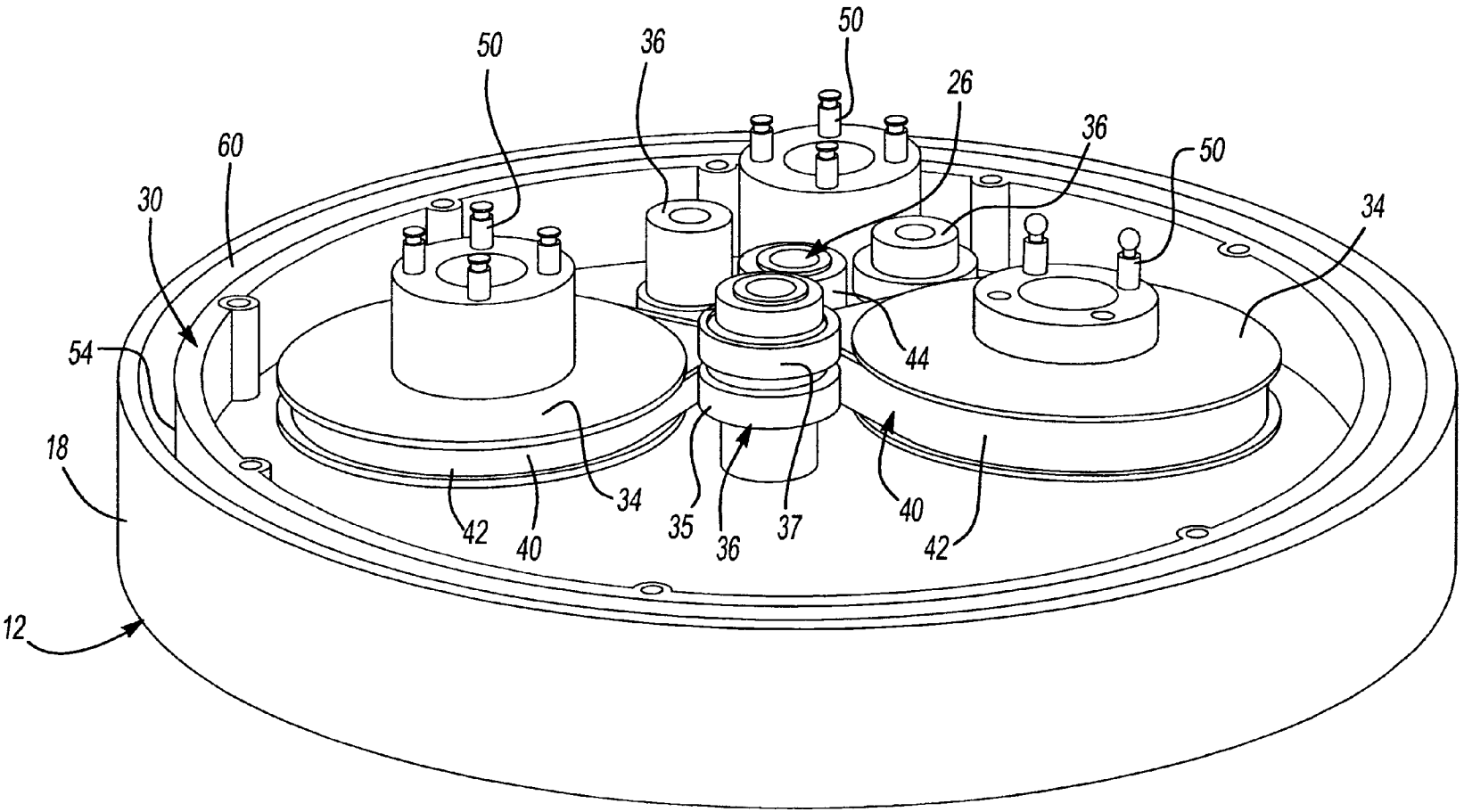
FIG. 7 is a bottom perspective view of the housing and inner bowl with the discs and belts removed for illustration purposes.

The drive shaft also extends through a center hole 28 of an inner bowl 30. The inner bowl is rotatable with both the housing 12 and the drive shaft 26. The bowl has a top portion 32 that rotatably mounts three pulleys 34 and three bearings 36 as best shown in FIGS. 5, 7, and 9. The pulleys 34 have a cogged periphery 38 that engages a respective cogged inner wall or inside side 42 of a belt 40. The cogged inner wall 42 of the belt also engages a central cogged pulley 44 affixed to the drive shaft 26. As the drive shaft rotates, the belt has a positive engagement with both the cogs 44 and the pulleys 34. As shown, three pulleys are each spaced about the drive shaft 120 degrees from each other.

Figure 3:
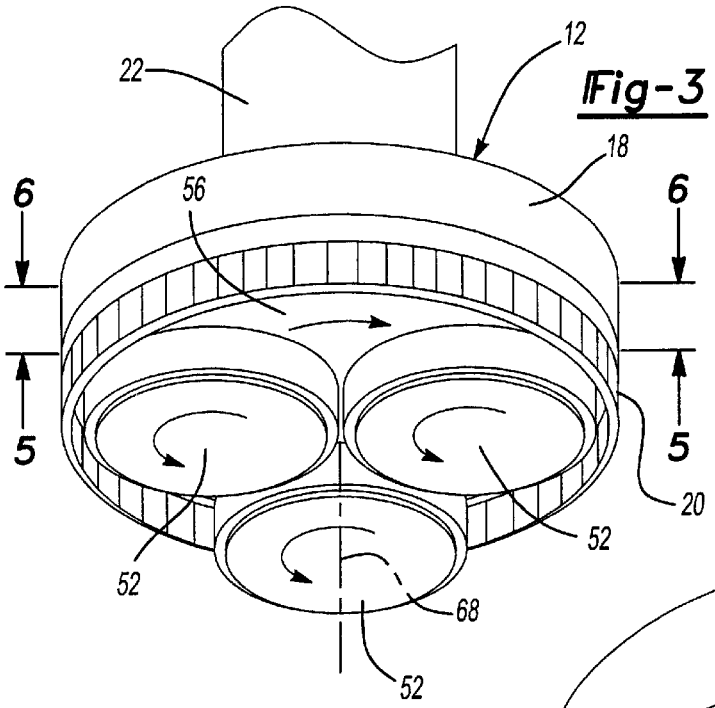
FIG. 3 is a bottom perspective view of the embodiment shown in FIG. 1.
Figure 4:
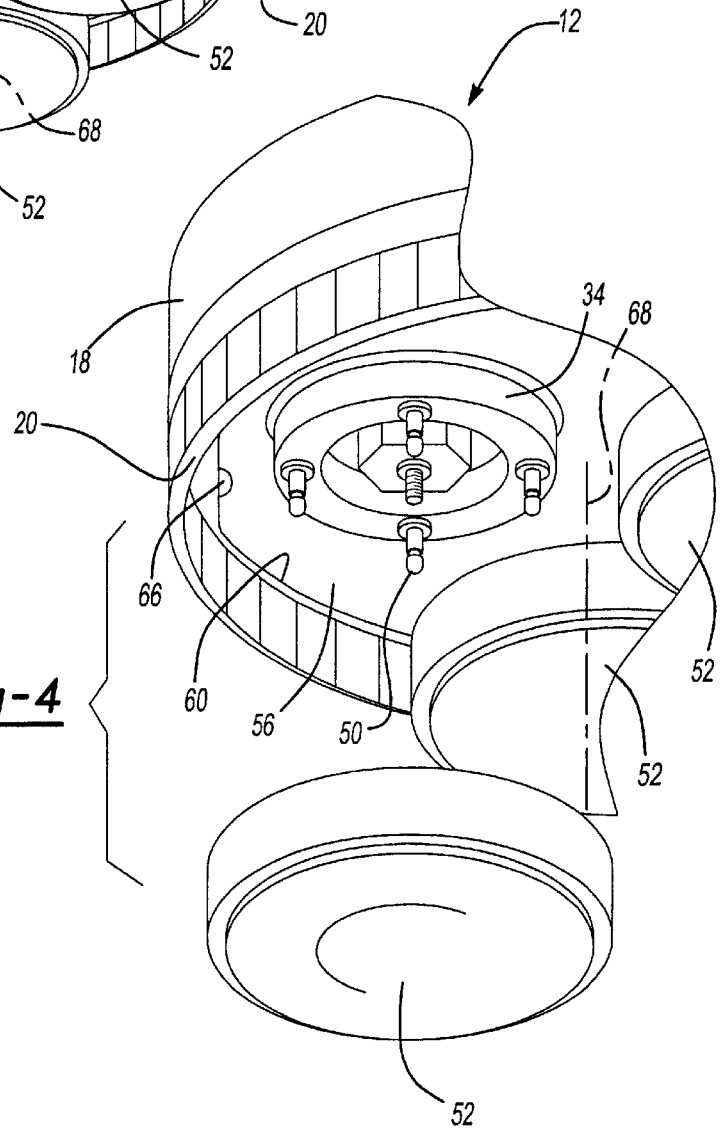
FIG. 4 is a lower perspective view showing one disc removed.
Figure 8:
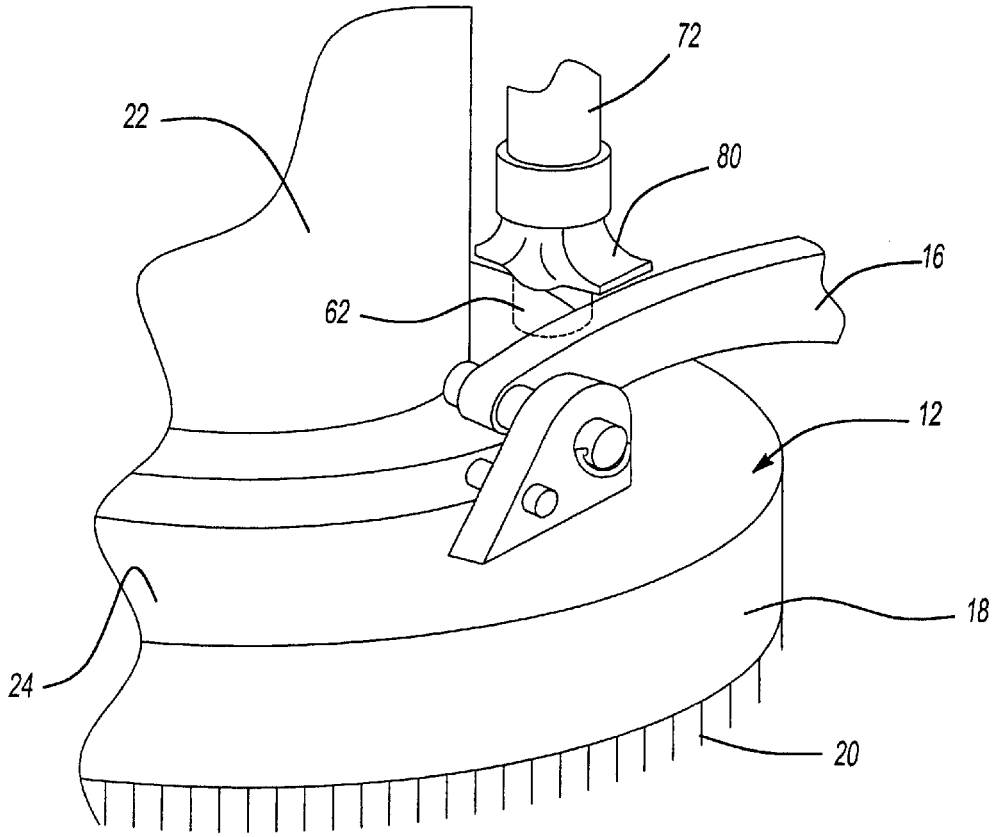
FIG. 8 is a fragmentary upper perspective view of the housing illustrating the lift handles, the vacuum hose connection, and the quick connect fitting between the housing and the operating handle.

The bearings 36 on the other hand are positioned to frictionally engage a flat outerside 46 of the belt 40. Each bearing is also positioned to place tension of a respective belt 40 and to provide enhanced engagement area between the belt and the pulleys 34 and cogs 44. As best shown in FIG. 5, each belt is actually tensioned by two bearings 36 which provide a pinching of the belt 40 about cog 44. The belts are vertically positioned at different heights from each other to provide non-interference. As shown in FIG. 8 the three cogs 44 are vertically positioned to engage a respective belt 40. The bearings 36 are split into an upper and lower sections 35 and 37 which each independently rotate with respect to the two adjacent belts that engage the bearing as best shown in FIG. 7. As shown in FIGS. 3 and 4, the pulleys have a mounting system 50 which are a plurality of pins for engaging cleaning elements or other abrasive elements commonly referred to as abrasive or sanding discs 52 in a snap fit fashion. The abrasive discs are sized to approach the outer periphery 18 of the housing 12. A peripheral brush 20 comes within one inch and preferably within ⅜ inches from the sanding disc 52. In this fashion, the power sander can sand or clean floors to within the edge of the floor that will normally then be covered by conventionally dimensioned shoe molding.

As the discs are driven by the motor in the direction as shown in FIGS. 3 and 4, the torque exerted by the rotation of the discs on the floor is greater at distances farther away from the central axis 68 of the drive shaft 26. As such, the discs' torque tends to pull and rotate the inner bowl in the direction shown in FIGS. 3 and 4. Hence the inner bowl 30 and the assembly of pulleys 34 and discs 52 counter rotate with respect to the rotation of the individual pulleys 34 and discs 52. The equal circumferential spacing of the pulleys 34 and discs 54 about the central drive shaft 26 eliminates virtually all side torque forces and provides for a balanced machine.

The inner bowl 30 has a side periphery 54 that mounts a steel weight plate 56. The plate has a dual purpose for reducing wood dust from intruding into the bowl 30 where it may interfere with the operating cogs 44, pulleys 34, and belts 40 and for adding the proper amount of weight to the sander to enhance sanding forces and balance to the machine. The balance significantly reduces chatter and provides for a faster machine. It can be easily appreciated, that chatter besides reducing control of the machine can put gouges into a floor surface and ruin the objective of a smoothly sanded floor. With the balance, built in weight and lack of sideways torque, the machine can operate with disc speeds as low as 350 rpms and still provide for effective sanding of wood floors.

Figure 6:
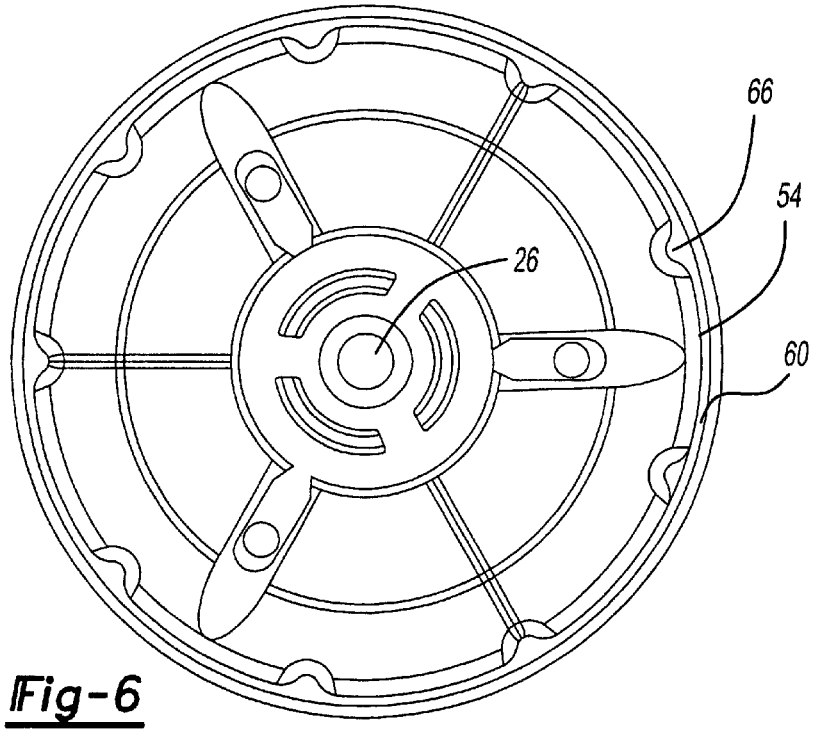
FIG. 6 is a cross sectional view taken along lines 6—6 shown in FIG. 3.

There is a gap 60 between the inner bowl 32 and the outer bowl 18 to allow a vacuum passage to an outlet nozzle 62 for the vacuum cleaner 16. As shown in FIG. 6, the inner bowl periphery 54 may have notches 66 to increase and assure air flow for the vacuum.

The vacuum 16 has a bottom mounted motor 70 and an inlet hose 72 mounted at a top portion of a vertically oriented canister housing 74. A vacuum bag 76 is also mounted in the vertically oriented canister 74. In this way, gravity also assists in settling the wood dust particles to the bottom of the bag 76 and to reduce airborne particulate. In addition, the canister 74 is made of metal and grounded to the machine such that the probability of an static spark occurring is reduced. Sparks should be reduced near wood dust and airborne wood particulate.

Figure 11:
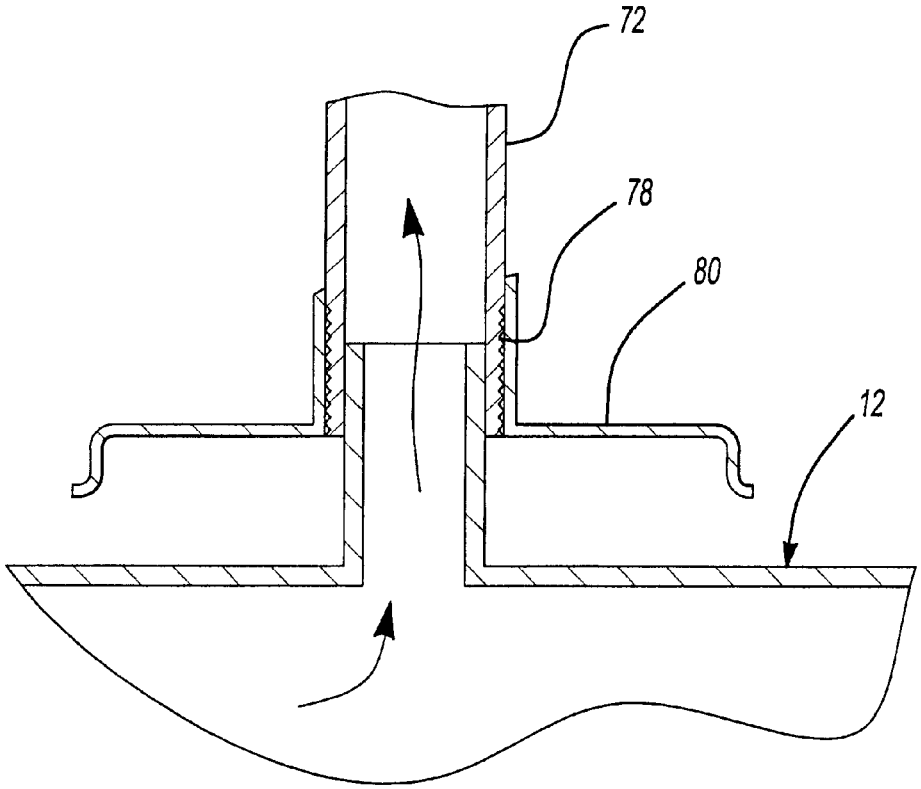
FIG. 11 is a segmented view illustrating the connection of the hose to the housing.

A flexible stretchable hose 72 connects the vacuum 16 to the housing 12. The hose can resiliently stretch well over triple its initial rest length. The end 78 of the hose connects to the nozzle 62. As best shown in FIG. 11, the end 78 has a brush or other shaped nozzle attachment 80 affixed thereto can be used by an operator as an independent vacuum cleaner to clean up saw dust and other particulates.

However, when the sanding machine 10 is operating, the hose end 78 with the attachment 80 still affixed thereto can be operably connected to the nozzle 62. The attachment 80 is shaped to receive the nozzle 62 and let the nozzle extend up to the hose and bypass the attachment 80 effective shape. In this way, the vacuum can be easily used both with the sanding machine and as an effective cleanup tool independent of the sanding machine. The machine 10 has a power switch which allows independent actuation of the vacuum without the actuation of the pulleys 34 and discs 54.

The motor for the vacuum is a two speed motor that has one speed for use during operation of the discs 52 and another higher speed when only the attachment 80 is being used for cleanup. The two speed motor allows for less noise during usage of the sanding machine. The low rpms of the power sanding discs and the lower vacuum operation provide for a sanding machine that is as quiet as a conventional wet/dry vacuum cleaner.

For ease of transportation, the housing 12 can easily disengage from and re-engage to the operating handle 14 via quick connect coupling pins 82. Furthermore to aid in transportation, the housing 12 has separate lifting handles 84 at its front and back.

Figure 12:
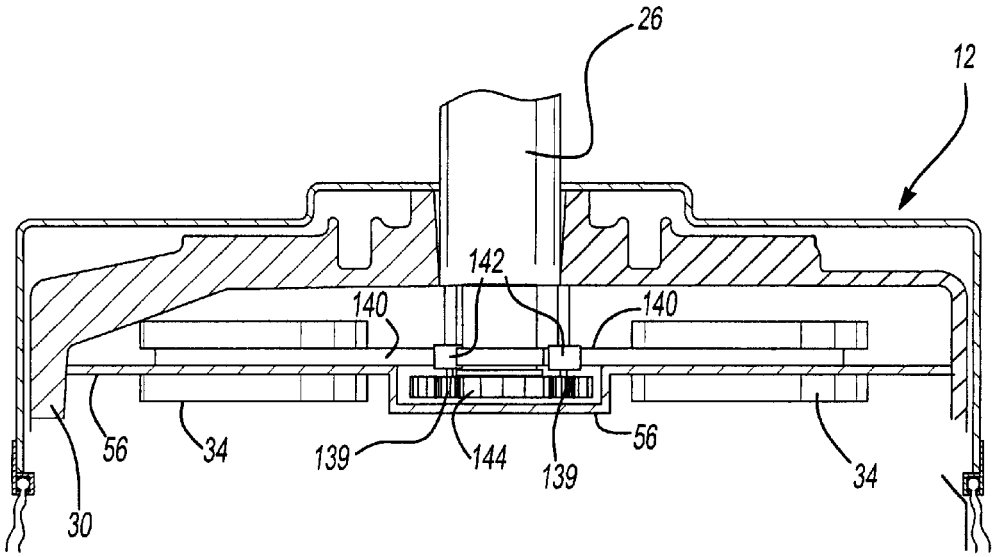
FIG. 12 is a segmented side elevational view of a second embodiment.
Figure 13:
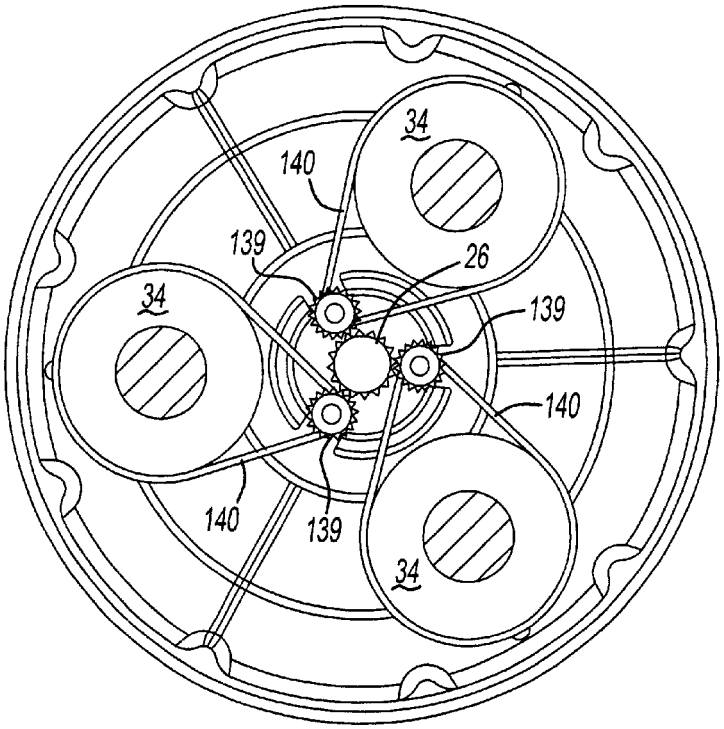
FIG. 13 is a bottom plan and partially exploded view of the embodiment shown in FIG. 12.

A second embodiment is of the machine is disclosed in FIGS. 12 and 13. This embodiment has three coplanar belts 140 that are mounted on pulleys 34 and smaller drive pulleys 142. The three coplanar drive pulleys 142 are driven via gear teeth 139 vertically spaced from the belt engaging section to a drive cog 144 on drive shaft 26. The three drive pulleys 142 are equally circumferentially spaced about the drive shaft 26. The belts may be optionally tensioned by bearings (not shown) on the exterior side of the belts in the same fashion as the first described embodiment. In this way, all three belts are coplanar which provides for a more compact lower profile housing 18.

Figure 14:
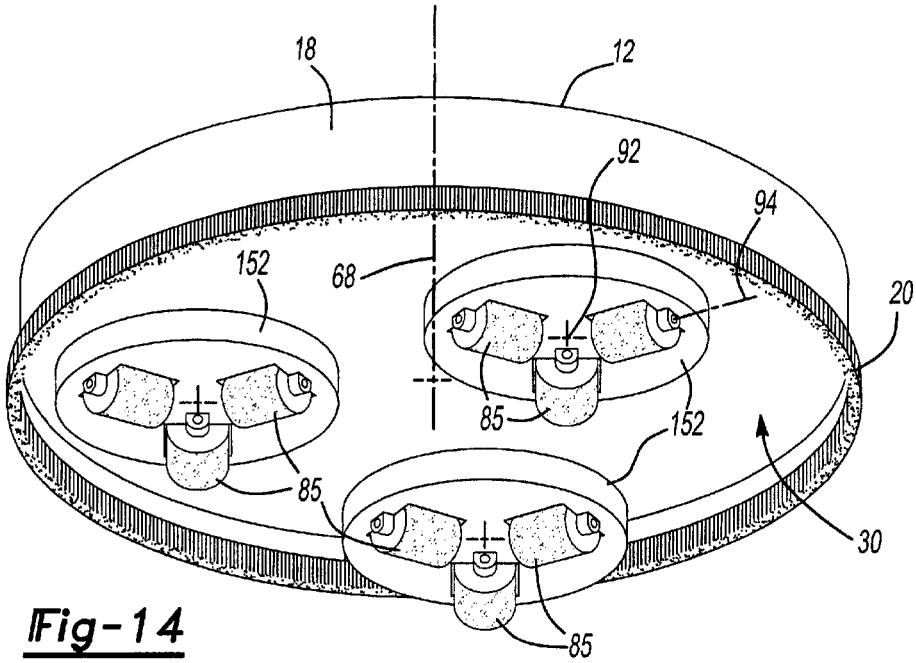
FIG. 14 is a bottom perspective view of another embodiment.
Figure 15:
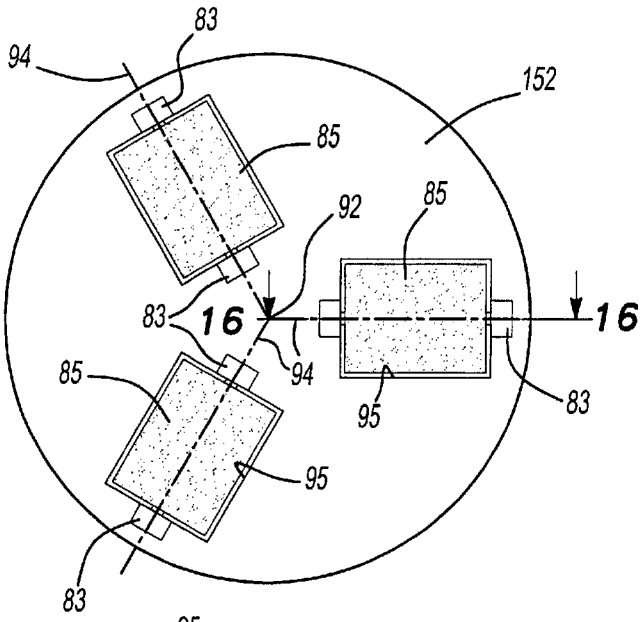
FIG. 15 is an enlarged bottom plan view of one plate member assembly shown in FIG. 14.
Figure 16:
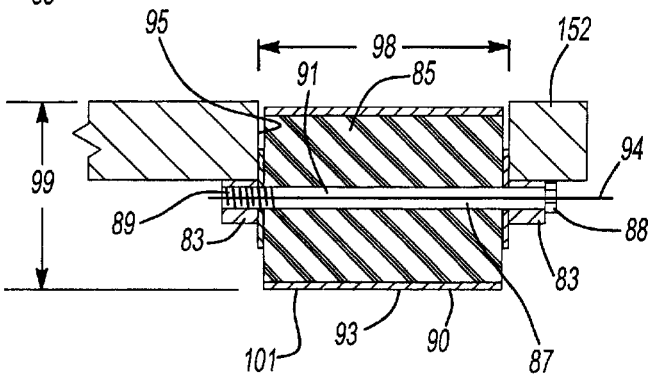
FIG. 16 is a cross sectional view taken along lines 16—16 shown in FIG. 15.

FIGS. 14–16 discloses an attachment to the power sander that render a more aggressive sanding operation to cut down the time it takes to remove old varnish and worn out coating on hardwood floors. The conventional discs 52 that snap fit on pins 50 are replaced by three plate assemblies 152. The plates have snap receptacles 251 like those shown in FIG. 17 for engaging pins 50. The plate also mounts three freewheeling rollers 85 cicumferentially mounted about the rotating axis 92 of each plate 152. The terms "freewheel" and "freewheeling" in this context means that the rollers are not powered or directly connected to the motor such as conventional drum sanders. Any rolling of the rollers is caused by the frictional action exerted from the floor as the plates and inner housing rotate.

The rollers 85 are rotatably mounted via a pin 87. The pin can be a conventional with a threaded end 88 and an engageable head 89 that engage the mounting lugs 83 that are welded to the plate 152. The roller rotates about the shank 91. If desirable, the roller may be affixed to the shank and the pin may be rotatably journalled in the lugs 83.

The roller desirably is made from a commercially available sponge rubber that has some flex to it. The outer surface 93 is fitted with a properly sized sand paper cylinder 90. The rollers and sand paper cylinder have an axial length 98 greater than their respective diameters 99. The roller and sand paper provide for a long narrow bottom section 101 along the roller that actively engages and sands that floor. It has been found that a sand paper cylinder with a grit rating of 50 provides sufficient aggressive action for sanding hardwood floors.

The plate has a cutout section 95 to allow the roller 85 to be recessed into the plane of the plate 152 to lower the vertical profile of the plate assembly 152. In this way when discs 52 replace the attachments 152 and vice versa, the machine retains the same vertical height and the brush 20 retains a proper orientation to the ground.

In operation, the pulleys are driven by the motor via the belts to rotate the plate member about the vertical axes 92. The rollers 78 rotate about a horizontal axis 94 defined by the pin 80. The axes 92 and 94 are transverse with each other and intersect. As the pulleys drive the plates 152, the rollers are free to rotate about their respective horizontal axis 94. However, due to the relative great axial length 98 of the roller, a significant amount of scrub takes place when the rollers freewheel. The sand paper thus works on the floor and the inner bowl 30 is free to counter rotate about its axis 68.

Figure 20:
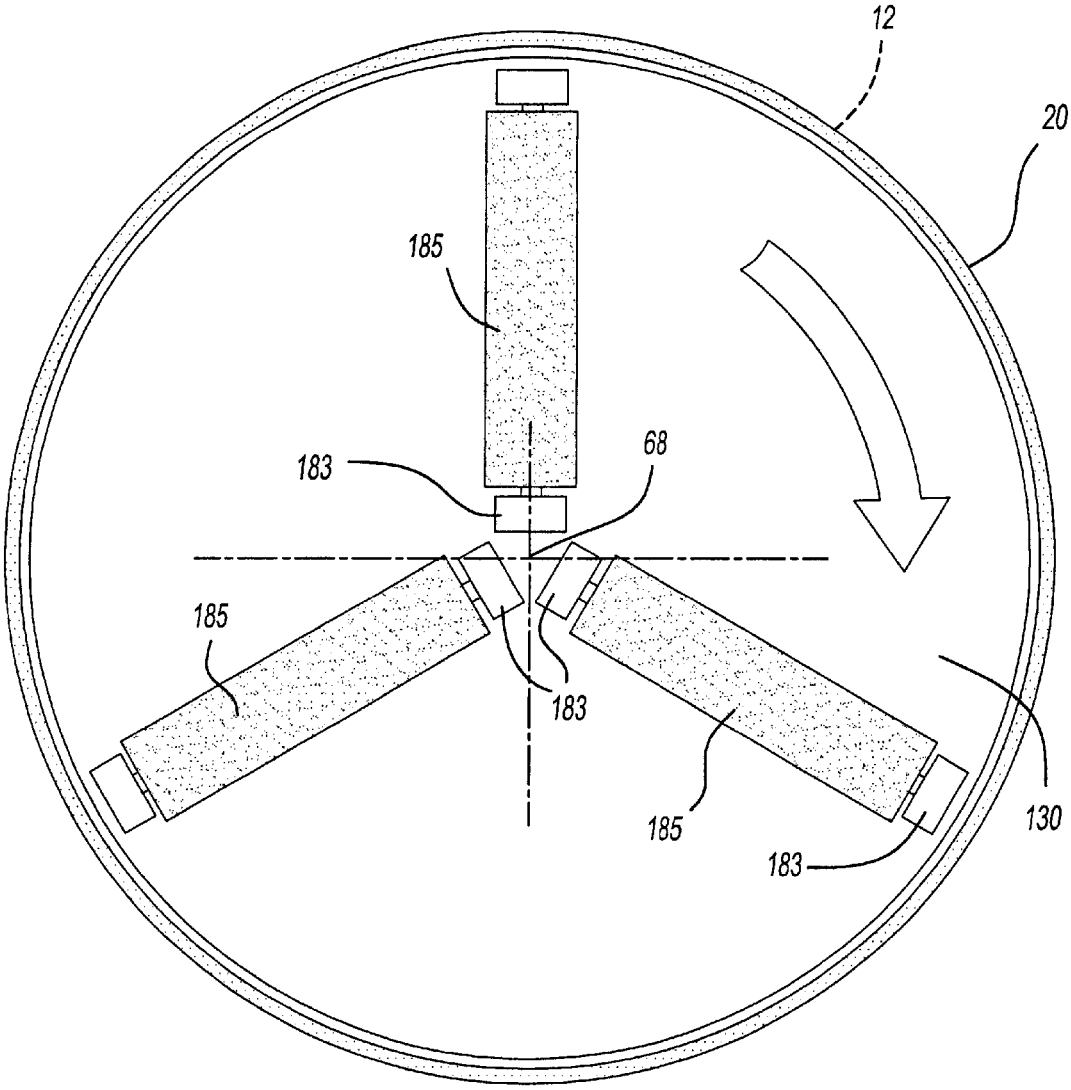
FIG. 20 is a bottom plan view of another embodiment of the invention.

A modified version of the freewheeling drum roller is illustrated in FIG. 20. In this embodiment, three rollers 185 are mounted for free wheeling via lugs 183 on the inner bowl 130. The rollers 185 like rollers 85 have an abrasive sand paper drum mounted thereon. In this embodiment, the motor conventionally rotates the inner bowl 130 at a desired speed depending on the application. The rollers 185 freewheel as the inner housing is rotated about its axis 68. Due to scrub action, the sandpaper drum sands the floor during the operation of the power sander.

Figure 17:
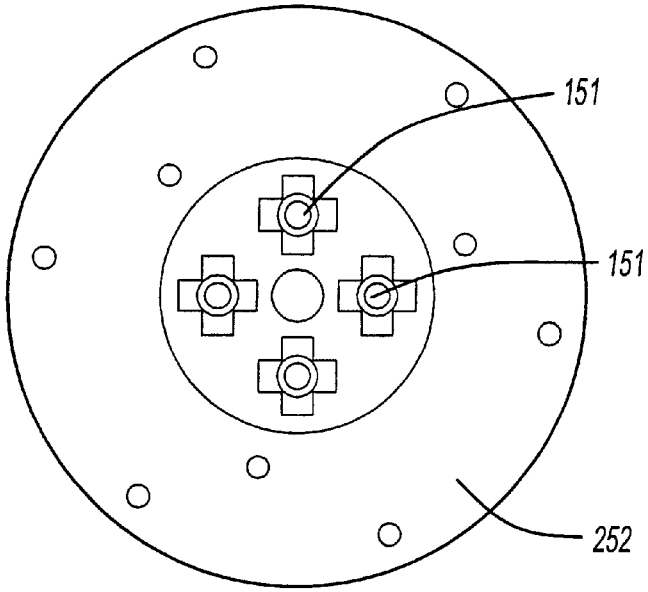
FIG. 17 is a top plan view of another attachment for the machine shown in FIG. 1.
Figure 18:
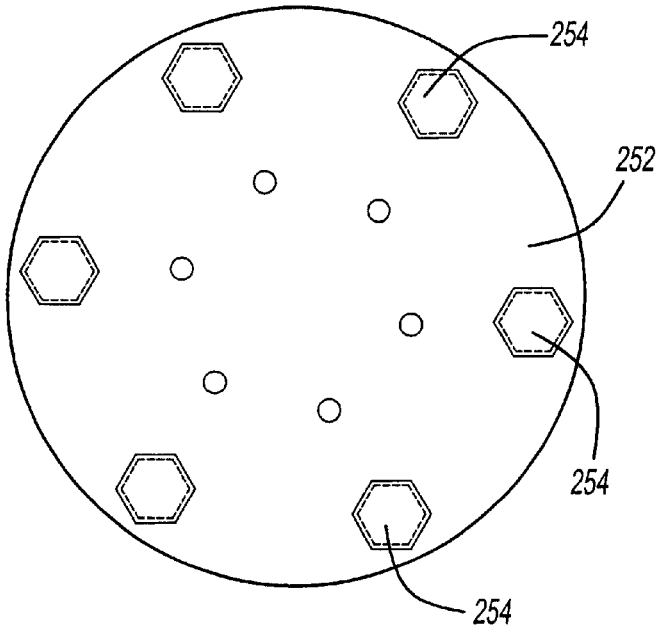
FIG. 18 is a bottom plan view of the attachment shown in FIG. 17.
Figure 19:
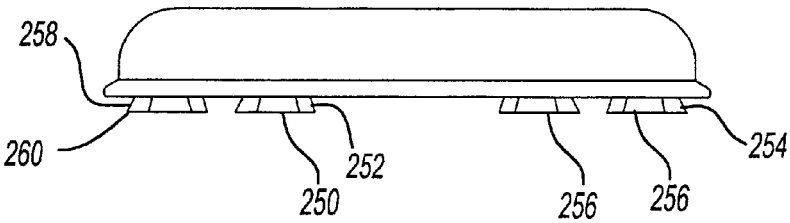
FIG. 19 is a side elevational view of the attachment shown in FIG. 18.

Another plate attachment device 252 is shown in FIGS. 17–19. In these Figures, the plate attachment 252 has six carbide steel tips 254 mounted about the periphery of the plate. The carbide steel tips have a planar bottom surface 256 and tapered sides 258 to create a sharp scarifying edge 260. This attachment 252 mounts onto the pins 50 via snap fit connections 151. This attachment is suitable for paint and adhesive removal from concrete floors, scarifying, and filing down high spots in cracked concrete floors. The attachments 152, 252, and sanding discs 52 are all interchangeable on the pin connection 50 of power sander machine 10. The single machine 10 has the ability to aggressively sand hardwood floors, finely sand hardwood floors, and work on concrete floors. The ability of this machine to have proper floor attachments eliminates the need for renting or using multiple machines. The aggressiveness of the rollers not only eliminates the need for a separate drum sander but also speeds up the operation such that most common sized jobs may be easily completed within one half to one work day.

Figure 21:
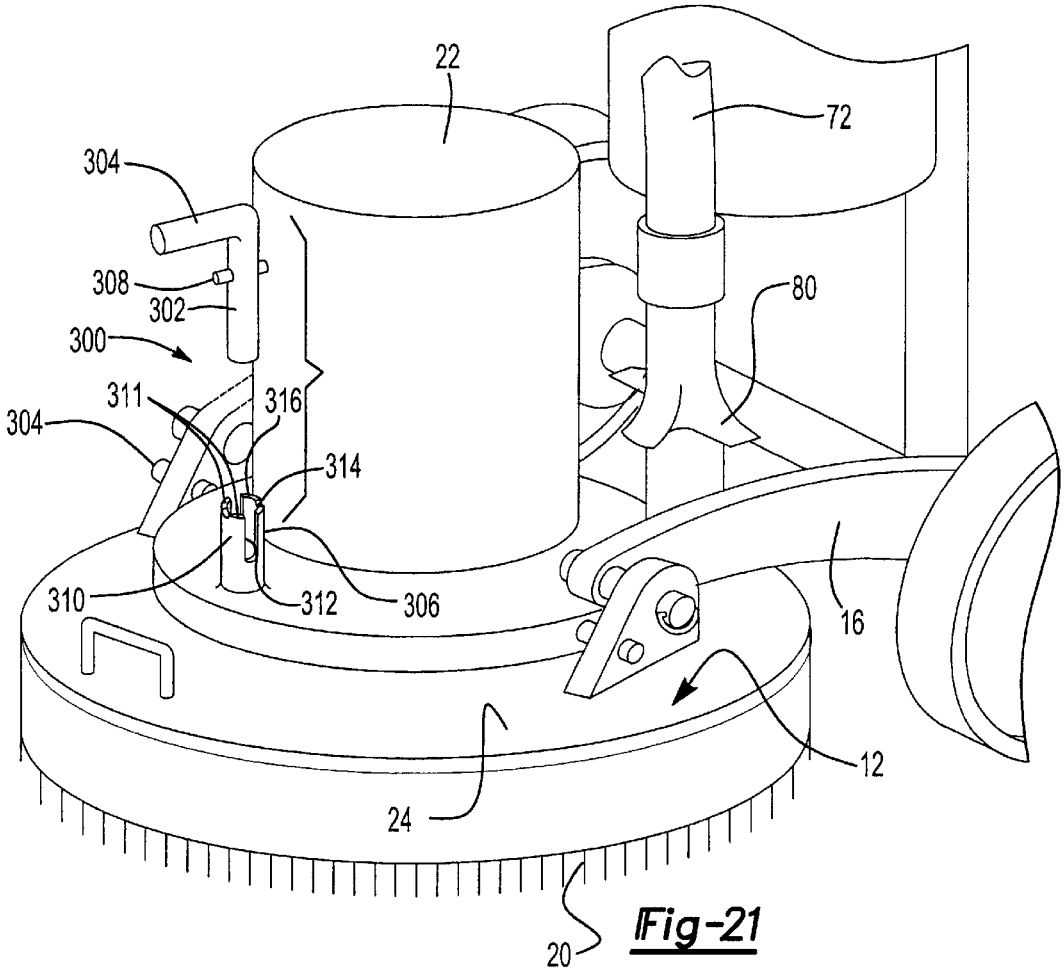
FIG. 21 is a fragmentary upper perspective view of another embodiment according to the invention.
Figure 22:
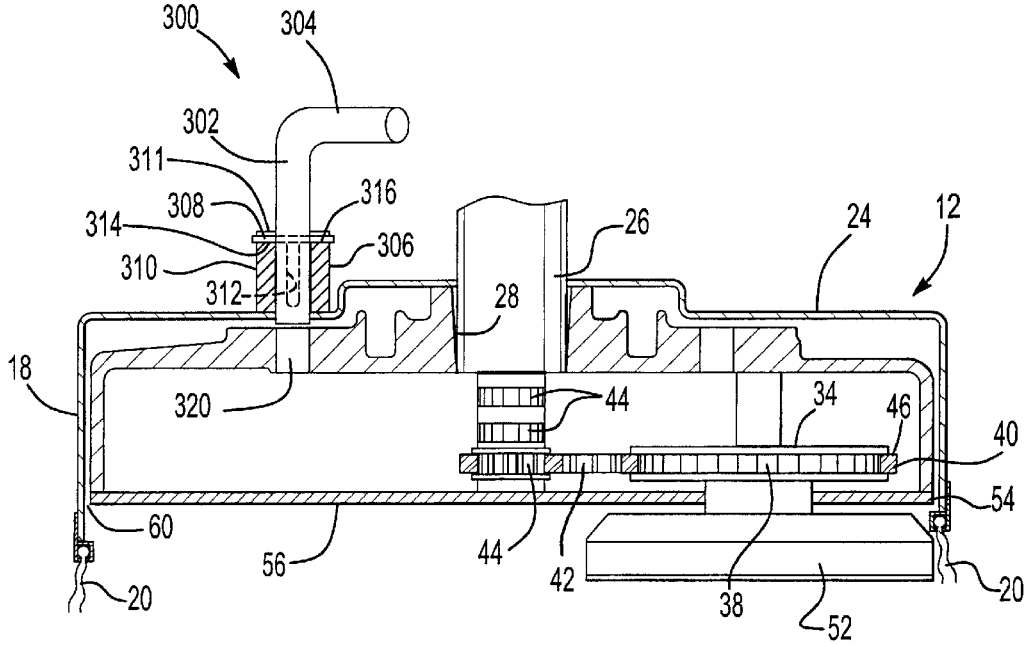
FIG. 22 is a side elevational fragmented view of the embodiment shown in FIG. 21.
Figure 23:
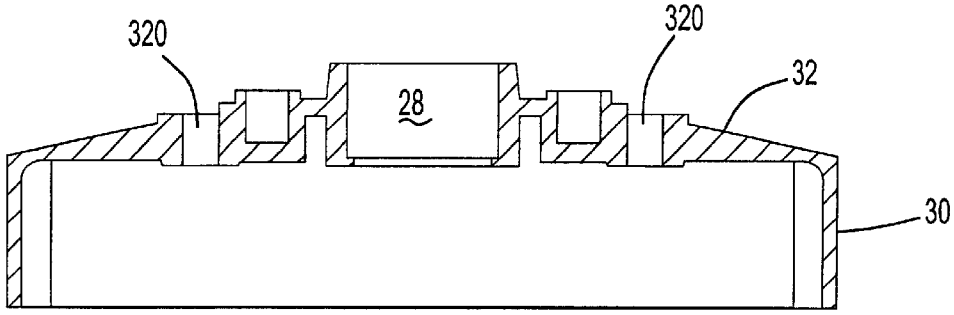
FIG. 23 is a side elevational fragmented view of the inner housing member shown in FIG. 22.
Figure 24:
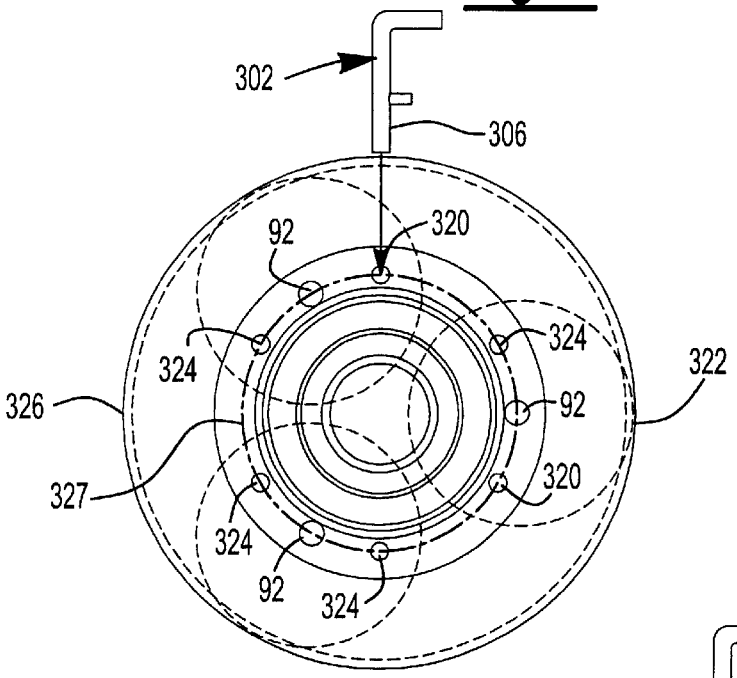
FIG. 24 is a top plan view of the inner housing member positioned to receive the lock pin for position a pulley and abrasive element at the right edge of the sander and housing.

The embodiments shown in FIGS. 1–13 can be modified to work as an edger. The embodiments shown in FIGS. 21–28 incorporate a mechanical lock 300 mounted on the housing 12. The lock 300 can be in front of the motor 22 as shown in FIGS. 21 and 22 along the longitudinal axis of the sander. The lock 300 includes a pin 302 with an upper handle 304 and locking shaft 306. A bayonet pin 308 passes through the shaft 306. The shaft 306 intrudes through a cylindrical holder 310 affixed to housing 12. The holder 310 has opposing slots 312 to receive bayonet pin 308. The pin can be in a disengaged position as shown in FIG. 22 with the bayonet pin 308 resting on a recess 314 on top edge 316 of holder 310. The shaft 306 extends through an aperture 318 in the housing. The pin 302 can be rotated to and lifted over retaining hump 311 to align bayonet pin 308 with the slots 312 and lowered in holder 310 and through aperture 318. The lower end of shaft 306 can engage a recess or aperture 320 in inner housing member. As shown in FIG. 24, the pin 302 when in aperture 320 rotatably locks the inner bowl 30 relative to the housing 12 such that a pulley 34 and a respective sander disc 52 is adjacent the right edge 322 of the housing 12.

In this manner, when a operator wants to concentrate on sanding or cleaning near an edge of a floor, he can lock the pulley 34 near the right edge of the sander and place the right edge of the machine at the edge of the floor. In this way, on pulley is always correctly positioned to provide more aggressive abrasive application at the edge of the floor by affixing the pulley and sander discs thereover.

Figure 25:
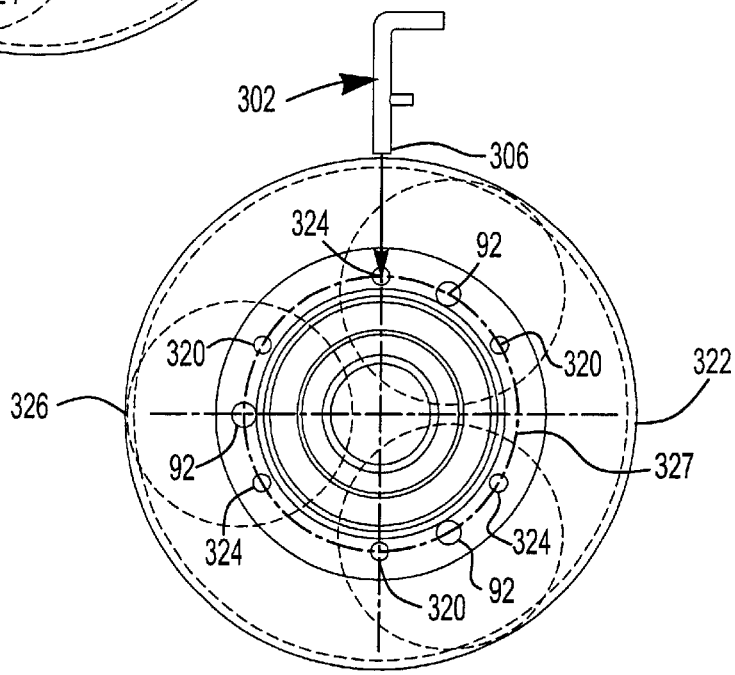
FIG. 25 is a top plan view similar to FIG. 24 showing the pulley and abrasive element positioned at the left edge of the sander and housing.

In a similar manner, as illustrated in FIG. 25, if a pulley 32 and sanding disc needs to be affixed near the left edge 326 of the housing 12, the pin 302 can be received in an aperture 324 positioned on the opposite side of the rotating axis 92 of a pulley or disc.

As such, whichever side edge is more convenient or accessible can be placed against the wall to sand an edge of the floor. A pulley and sanding disc is then locked in position and can rotate about its own axis 92 for more aggressive application to the edge of the floor.

For added convenience, similar apertures 320 and 324 can be placed in inner bowl member 30 such that a choice of any of the pulleys and sanders can be used for right or left edge sanding or cleaning. The pin 302 can engage any one of the set of apertures 320 for right edge sanding and any one of the set of apertures 324 for left edge cleaning.

If there are three pulleys 34 each spaced 120° from each other as illustrated, the apertures 320 and 324 need to be 60° from each other to properly and circumferentially position and affix a pulley 34 and sander disc 52 at the left or right edge. In the illustrated embodiment aperture 32° is 30° clockwise from axis 92 while aperture 324 is 30° counterclockwise from axis 92. Both sets of apertures 320 and 324 are circumferentially spaced about a circle 327 of radius R.

Figure 26:
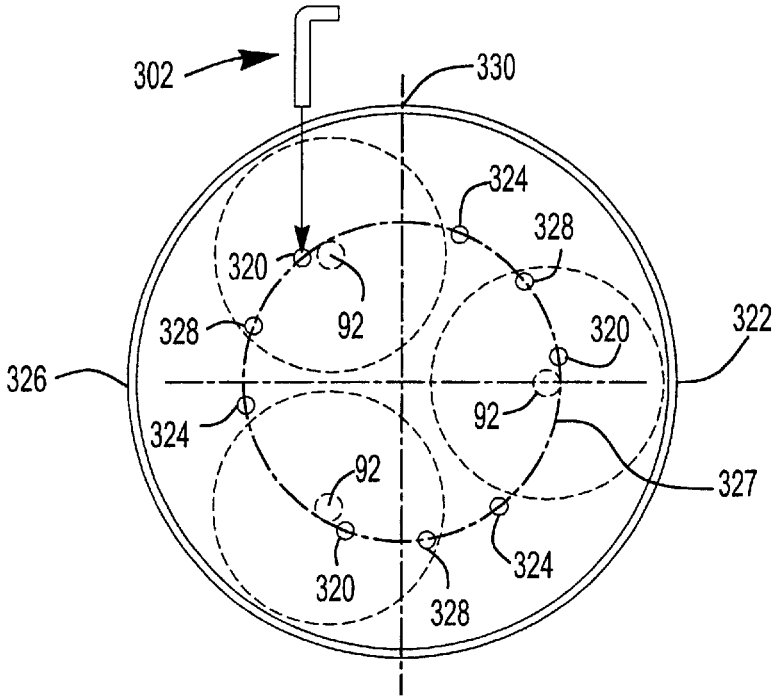
FIG. 26 is a top plan view illustrating an alternative arrangement of recesses in which the pulley is affixed at the left edge of the sander.
Figure 27:
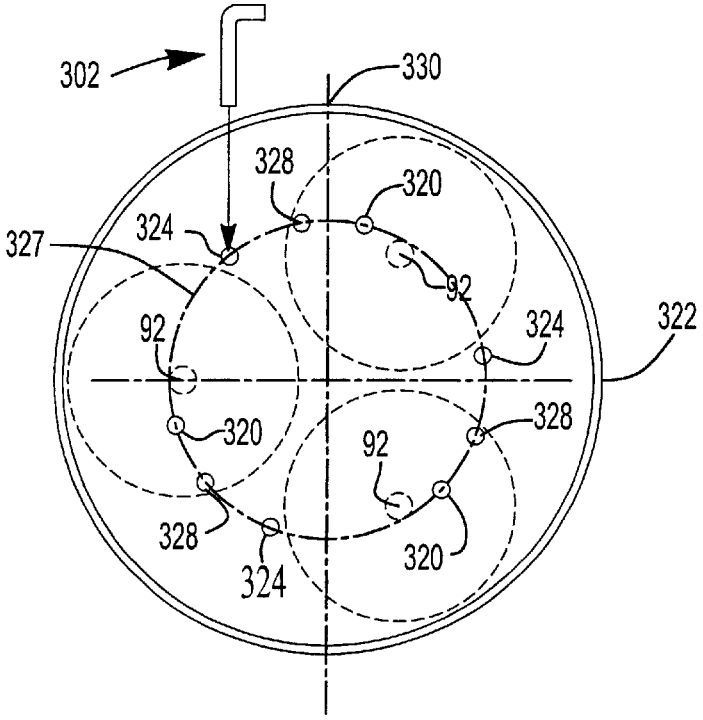
FIG. 27 is a view similar to FIG. 26 illustrating the pulley affixed to the right edge of the sander.
Figure 28:
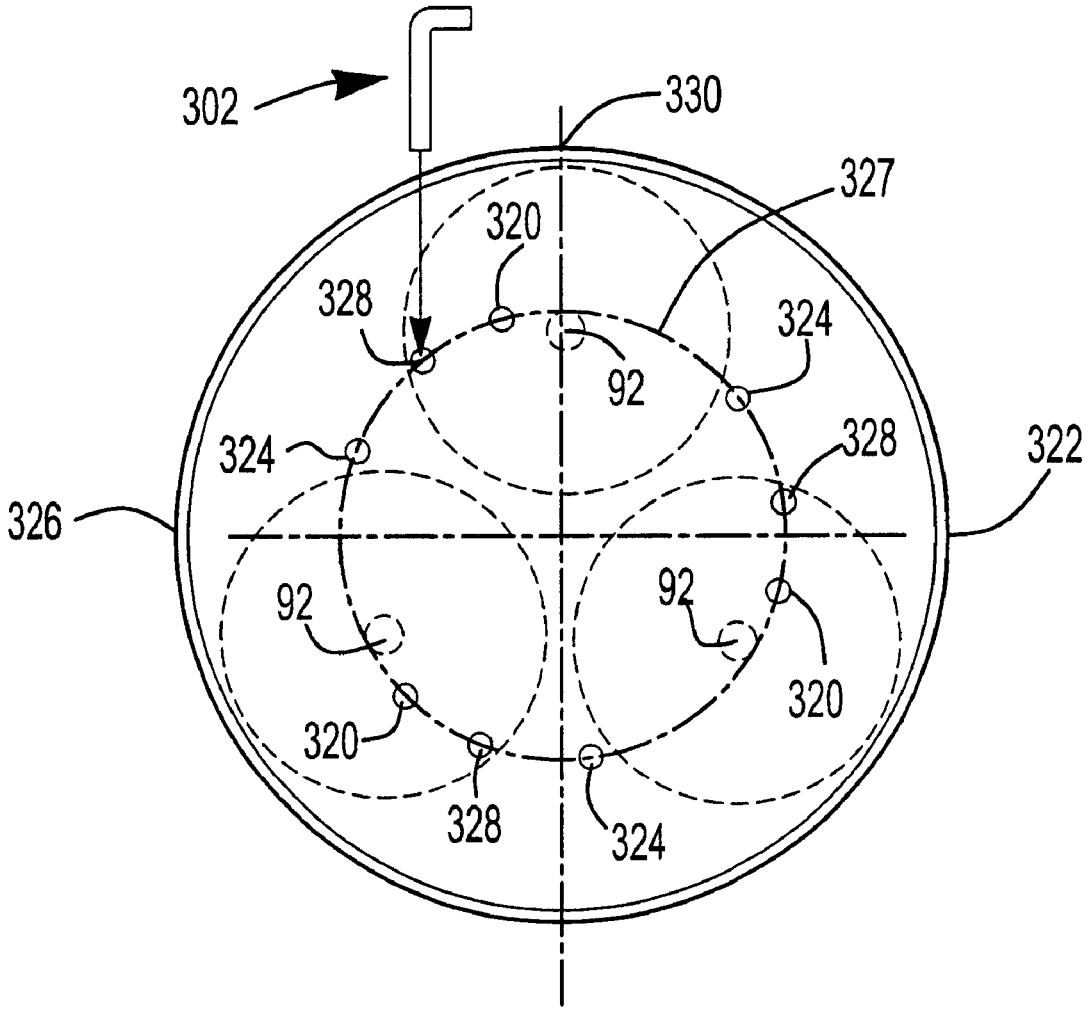
FIG. 28 is a view similar to FIG. 26 illustrating a pulley affixed at the front end of the sander.
Figure 1:
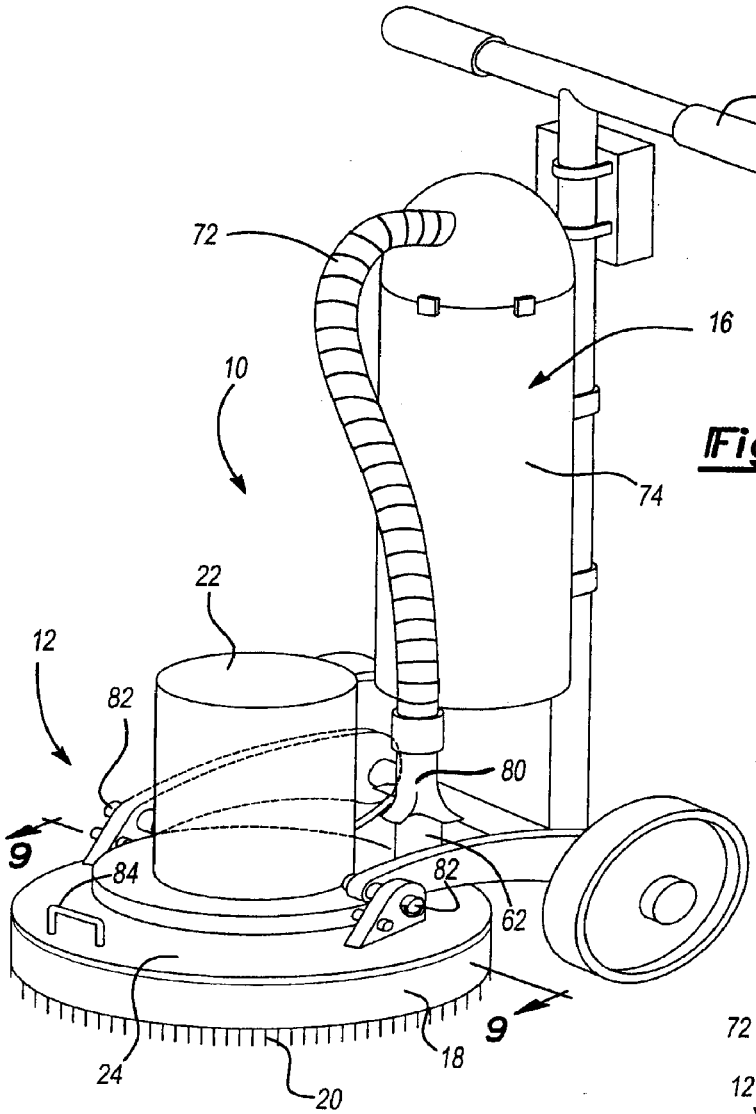
Figure 2:
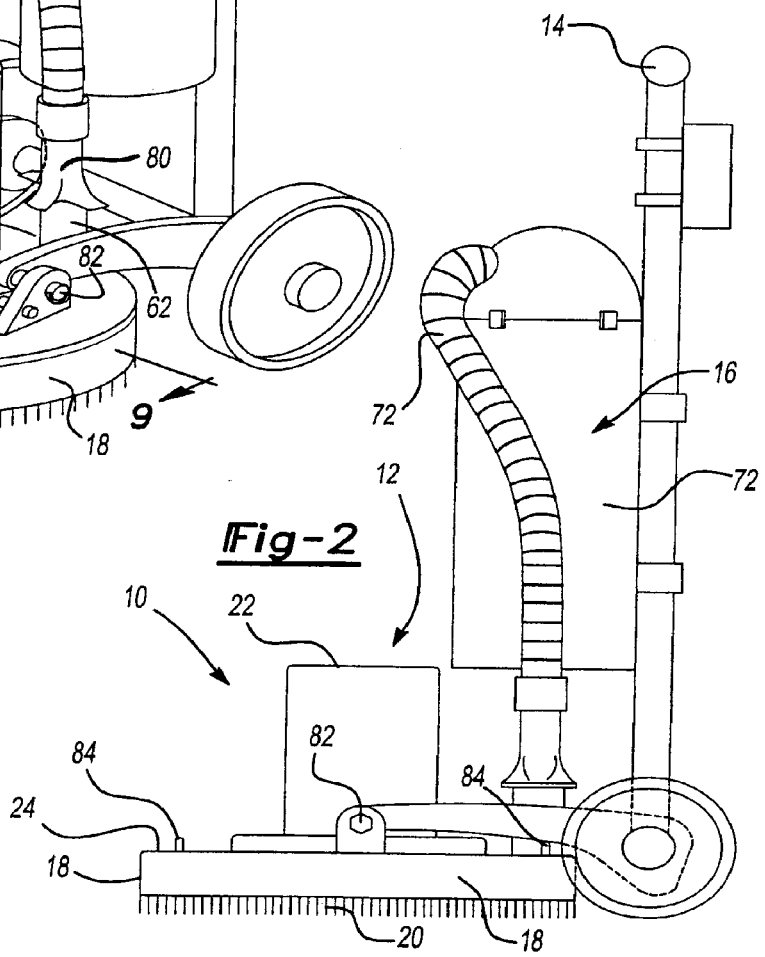

FIGS. 26–28 show an alternative arrangement of aperture 320 and 324. In this arrangement the pin 302, holder 310 and the aperture 318 can be circumferentially offset from the central longitudinal axis 92 of the sander disc, for example by 45° in the counterclockwise direction as shown.

The set of apertures 320 and the set of apertures 324 are similar circumferentially rotated 45° in the counterclockwise direction on inner bowl member from the embodiment shown in FIGS. 21–25. In this fashion a third set of apertures 326 can be placed in inner bowl circumferentially between aperture 320 and 324, i.e., 30° from each aperture 320 and 324 and also on circle 327.

As with the previous embodiment, when pin 302 engages one of the apertures 320, the respective pulley 32 is positioned along the right edge 322 as shown in FIG. 26. When the pin 302 engages one of the apertures 324, a respective pulley 32 is positioned along the left edge 326 as shown in FIG. 27.

In addition, when pin 302 engages any one of the apertures 328, a pulley and sander disc is then affixed along the front edge, i.e., front end 330 at the central longitudinal axis of the sander machine. The sander then can sand an edge of a floor from the front where it might be inaccessible from the right or left edges due to a tight fit that would not let the handle and the operator near the respective edge of the floor.

As with the right and left rear set of apertures 320 and 324, a third set of apertures 328 allows a choice of each pulley and disc to be used as the primary sander at the front edge 330 of the sander 10.

Variations and modifications are possible without departing from the scope and spirit of the present invention as defined by the appended claims.

The embodiments in which an exclusive property or privilege is claimed are defined as follows:

1. A power cleaning and sanding machine for a wood floor comprising:

a housing;

a motor mounted to said housing and having a drive shaft;

an inner housing member positioned within said housing and rotatably mounted on said drive shaft to allow rotation of said inner housing member with respect to both said housing and drive shaft;

a plurality of pulleys circumferentially spaced about said drive shaft, operably connected to said drive shaft, and rotatably connected to said inner housing member;

each pulley constructed to have a abrasive member mounted thereon;

said inner housing being selectively rotationally affixed to said housing by a mechanical lock that is able to lock a pulley in a circumferentially selected position about the drive shaft.

2. A power cleaning and sanding machine as defined in claim 1 further comprising:

said mechanical lock being in the form of a pin movable between a lower position extendable through an aperture in the housing and engaging a recess in the inner housing and an upper position where it is removed from the recess in the inner housing.

3. A power cleaning and sanding machine as defined in claim 2 further comprising:

said recess in the inner housing circumferentially positioned about the inner housing such that when said pin engages said recess, one of said pulleys is positioned toward one of the right or left sides of the housing member.

4. A power cleaning and sanding machine as defined in claim 3 further comprising:

said housing having a first and second recess with said first recess, when engaged with the pin locks one pulley at the left side of the housing and with the second recess when engaged with the pin locks one pulley at the right side of the housing member.

5. A power cleaning and sanding machine as defined in claim 4 further comprising:

said housing having a third recess with said third recess when engaged with the pin locks the pulley at the front end of the housing.

6. A power cleaning and sanding machine as defined in claim 2 further comprising:

said housing recess in the inner housing circumferentially positioned about the inner housing such that when said pin engages said recess, one of said pulleys is positioned at the front end of said housing.

7. A power cleaning and sanding machine as defined in claim 1 further comprising:

said mechanical lock being constructed to selectively lock any of the pulleys to be positioned at the left or right sides of said housing.

8. A power cleaning and sanding machine as defined in claim 1 further comprising:

said mechanical lock being constructed to selectively lock any of said pulleys at the left or right side or front end of said housing.

9. A power cleaning and sanding machine for a wood floor comprising:

a housing;

an operable handle extending behind the rear end of said housing;

a motor mounted to said housing and having a centrally positioned downwardly extending drive shaft;

an inner housing member positioned within said housing and rotatably mounted on said drive shaft to allow rotation of said inner housing member with respect to both said housing and drive shaft;

a plurality of pulleys circumferentially spaced about said drive shaft and rotatably connected to said inner housing member;

the axis of rotation of each pulley being parallel to the axis of rotation of said drive shaft;

each pulley constructed to have abrasive elements mounted thereon;

a plurality of belts, each belt mounted about a respective one pulley and engageably driven by the drive shaft;

a mechanical lock constructed to selectively lock the inner housing against rotation with respect to said housing;

said inner housing member being freely rotatable with respect to said housing when said mechanical lock is disengaged and for affixing a pulley at a side edge of said housing when engaged to affix the inner housing member with the housing.

10. A power cleaning and sanding machine as defined in claim 9 further comprising:

said mechanical lock being in the form of a pin movably between a lower position extendable through an aperture in the housing and engaging a recess in the inner housing and an upper position where it is removed from the recess in the inner housing.

11. A power cleaning and sanding machine as defined in claim 10 further comprising:

said recess in the inner housing circumferentially positioned about the inner housing such that when said pin engages said recess, one of said pulleys is positioned toward one of the right or left sides of the housing member.

12. A power cleaning and sanding machine as defined in claim 10 further comprising:

said housing having a first and second recess with one recess when engaged with the pin locks one pulley at the left side of the housing and when the second recess when engaged with the pin locks one pulley at the right side of the housing member.

13. A power cleaning and sanding machine as defined in claim 12 further comprising:

said housing having a third recess with said third recess when engaged with the pin locks the pulley at the front end of the housing.

14. A power cleaning and sanding machine as defined in claim 10 further comprising:

said housing recess in the inner housing circumferentially positioned about the inner housing such that when said pin engages said recess, one of said pulleys is positioned at the front end of said housing.

15. A power cleaning and sanding machine as defined in claim 9 further comprising:

said mechanical lock being constructed to selectively lock any of the pulleys to be positioned at the left or right sides of said housing.

16. A power cleaning and sanding machine as defined in claim 9 further comprising:

said mechanical lock being constructed to selectively lock any of said pulleys at the left or right side or front end of said housing.

* * * * *

UNITED STATES PATENT AND TRADEMARK OFFICE

CERTIFICATE OF CORRECTION

PATENT NO. : 6,752,707 B1
DATED : June 22, 2004
INVENTOR(S) : Simon Palushi

It is certified that error appears in the above-identified patent and that said Letters Patent is hereby corrected as shown below:

Title page,
Item [73], Assignee, "On Floor Technologies, L.L.C." should be
-- OnFloor Technologies, L.L.C. --.

Figure 2:
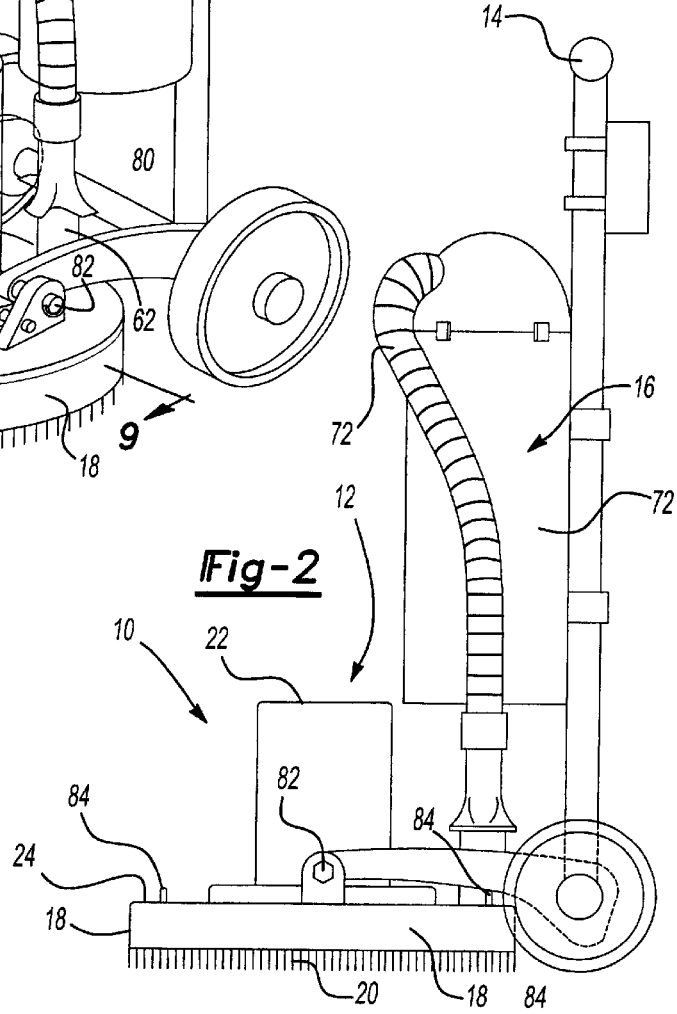
FIG. 2 is a side elevational view of the sander shown in FIG. 1.

Drawings,
Replace Sheet 1 of 14, consisting of Figs. 1 and 2 with the attached drawing.

Column 1,
Line 6, after "U.S. Pat. No." delete "6,595,835" and insert -- 6,595,838 --.

Column 6,
Line 19, after "pin for" delete "position" and insert -- positioning --.

Column 7,
Line 54, after "probability of" delete "an" and insert -- a --.

Column 8,
Line 22, after "embodiment" delete "is".

Column 9,
Line 65, after "when" delete "a" and insert -- an --.

Column 10,
Line 1, after "in this way" delete "on" and insert -- one --.
Line 26, after "aperture" delete "32°" and insert -- 320 --.

Column 11,
Line 11, after "have" delete "a" and insert -- an --.

UNITED STATES PATENT AND TRADEMARK OFFICE

CERTIFICATE OF CORRECTION

PATENT NO. : 6,752,707 B1
DATED : June 22, 2004
INVENTOR(S) : Simon Palushi

It is certified that error appears in the above-identified patent and that said Letters Patent is hereby corrected as shown below:

Column 12,
Line 25, after "a pin" delete "movably" and insert -- movable --.

Signed and Sealed this

Seventh Day of February, 2006

JON W. DUDAS
*Director of the United States Patent and Trademark Office*